US005819876A

United States Patent [19]

Chao

[11] Patent Number: 5,819,876

[45] Date of Patent: Oct. 13, 1998

[54] ELEVATOR WITH ELECTRIC/MANUAL DUAL DRIVING MODE

[76] Inventor: Wen-Bing Chao, No. 8, Lane 27, Chung-Yang Rd., Sec. 3, San Chung City, Taipei Hsien, Taiwan

[21] Appl. No.: 736,012

[22] Filed: Oct. 23, 1996

[51] Int. Cl.[6] ..... B66B 11/08

[52] U.S. Cl. ..... 187/263; 187/266

[58] Field of Search ..... 187/263, 266, 187/254, 261, 350

[56] References Cited

U.S. PATENT DOCUMENTS 4,592,450 6/1986 Schaffer ..... 187/263

FOREIGN PATENT DOCUMENTS 402033080 2/1990 Japan ..... 187/263

*Primary Examiner*—Kenneth Noland

*Attorney, Agent, or Firm*—Beveridge, DeGrandi, Weilacher & Young LLP

[57] ABSTRACT

An elevator with electric/manual dual driving-mode including a cab suspended from a beam at the top of an elevator well by a host cable, a winch mounted on the cab and driven by a reversible motor to take up/let off the host cable so as to lift/lower the cab, and a manual drive means for turning the reversible motor in driving the winch manually by a person in the cab in an emergency case, wherein the manual drive means includes a gear shaft supported on a bearing in a support outside the cab, clutch means controlled by a clutch switch to couple said gear shaft to the motor shaft of said reversible motor, a hand wheel disposed inside the cab and coupled to the gear shaft by a chain transmission mechanism and turned to rotate the reversible motor through the gear shaft, and a clutch switch controlled to move the clutch means into engagement with the gear shaft and a rear extension shaft of the reversible motor, for permitting the reversible motor to be turned with the gear shaft.

6 Claims, 11 Drawing Sheets

ELEVATOR WITH ELECTRIC/MANUAL DUAL DRIVING MODE

BACKGROUND OF THE INVENTION

In a conventional elevator, as shown in FIG. 1, the power drive unit 2' is installed in a control room at the top of the elevator well, and the cab 1' is suspended from the power drive unit 2' by host cables 3'. The power drive unit 2', as shown in FIG. 2, comprises a winch 7' controlled to take up or let off the host cables 3', a reversible motor 14' controlled to turn the winch 7' forwards or backwards, an electromagnetic brake 11' and a fan 15' and a brake block 16' respectively disposed adjacent to the reversible motor 14', a reducing gear 18' supported on bearings 17' and coupled between the power output end of the reversible motor 14' and the power input end of the winch 7'. The reducing gear 18' is comprised of a worm 12' and a worm gear 13' meshed together. When the elevator is out of order, or stopped due to a power failure or a fire, the passengers inside the cab have to call outside people for help. When the maintenance person comes, he can then uses a tool to tun the extension shaft 6 of the motor 14 manually, so as to drive the winch 7 in taking up or letting off the host cables 3. However, when in a fire, the maintenance person may be unable to reach the control room.

There is known an elevator with DC motor/manual dual driving mode which uses a DC motor or man power to turn a winch and a reducing gear in taking up or letting off a host cable, so as to lift or lower a cab. This structure of elevator is functional, however its complicated transmission structure greatly increases the manufacturing cost, and complicates the maintenance work. Further, because this structure of elevator consumes DC power supply, the DC motor is unable to be operated when power low.

SUMMARY OF THE INVENTION

It is one object of the present invention to provide an elevator with electric/manual dual driving-mode which permits the passengers to lift/lower the cab manually in an emergency case. It is another object of the present invention to provide an elevator which can be operated by DC power supply when AC power supply fails. It is still another object of the present invention to provide a power drive unit for an elevator which is simple in structure and inexpensive to manufacture. According to one aspect of the present invention, elevator with electric/manual dual driving-mode comprises a cab suspended from a beam at the top of an elevator well by a host cable, a winch mounted on the cab and driven by a reversible motor to take up/let off the host cable so as to lift/lower the cab, and a manual drive means for turning the reversible motor in driving the winch manually by a person in the cab in an emergency case, wherein the manual drive means includes a gear shaft supported on a bearing in a support outside the cab, clutch means controlled by a clutch switch to couple said gear shaft to the motor shaft of said reversible motor, a hand wheel disposed inside the cab and coupled to the gear shaft by a chain transmission mechanism and turned to rotate the reversible motor through the gear shaft, and a clutch switch controlled to move the clutch means into engagement with the gear shaft and a rear extension shaft of the reversible motor, for permitting the reversible motor to be turned with the gear shaft. According to another aspect of the present invention, fluorescent floor marks are made on the wall of the elevator well so that the passengers in the cab can quickly find out the position of the cab through a view hole.

DETAILED DESCRIPTION OF THE PREFERRED EMBODIMENT

Figure 1:
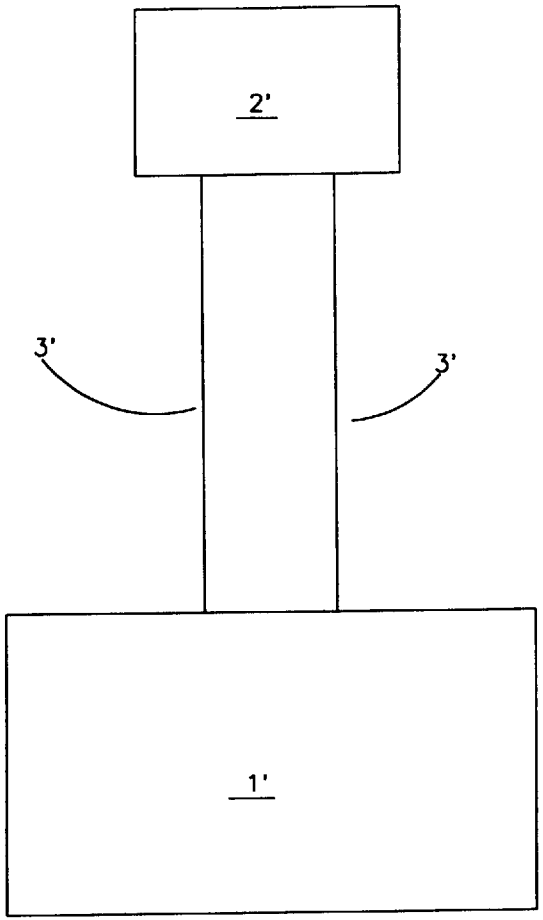
FIG.1 PRIOR ART
FIG. 1 is a schematic drawing showing the arrangement of an elevator according to the prior art.
Figure 2:
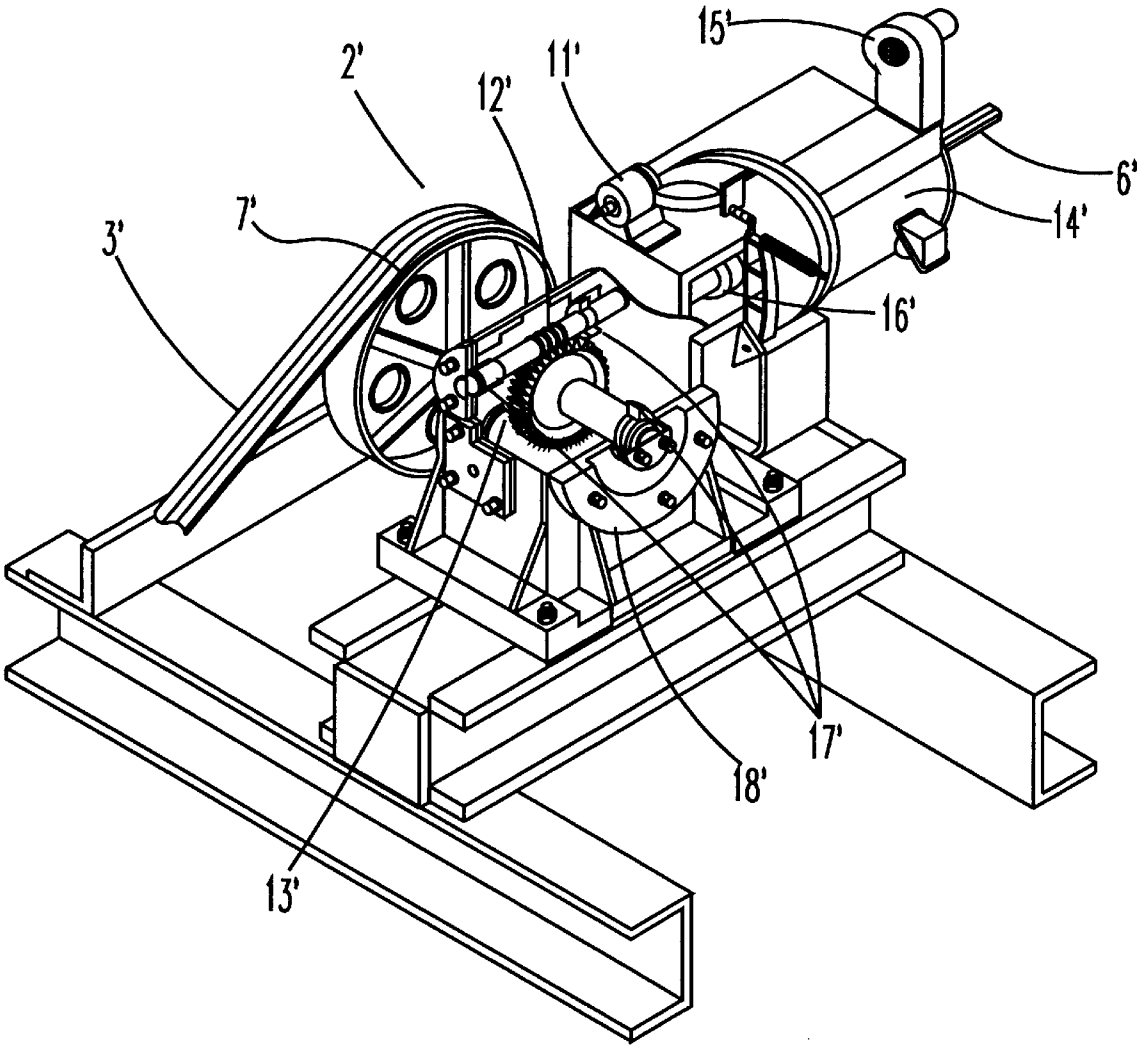
FIG. 2 PRIOR ART
FIG. 2 is an elevational perspective view of a power drive unit for an elevator according to the prior art.
Figure 3:
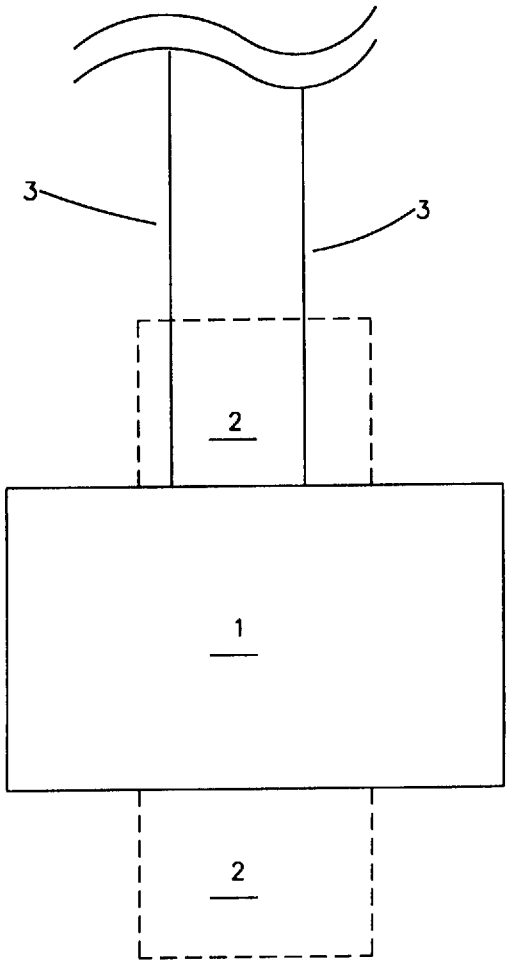
FIG. 3 is a schematic drawing showing the arrangement of an elevator according to the present invention.

Referring to FIG. 3, the power drive unit 2 may be installed in the cab 1 at the top or bottom side, and moved with the cab 1 along the host cable 3. The host cable 3 is fixedly connected to a beam in the control room at the top of the elevator well.

Figure 4:
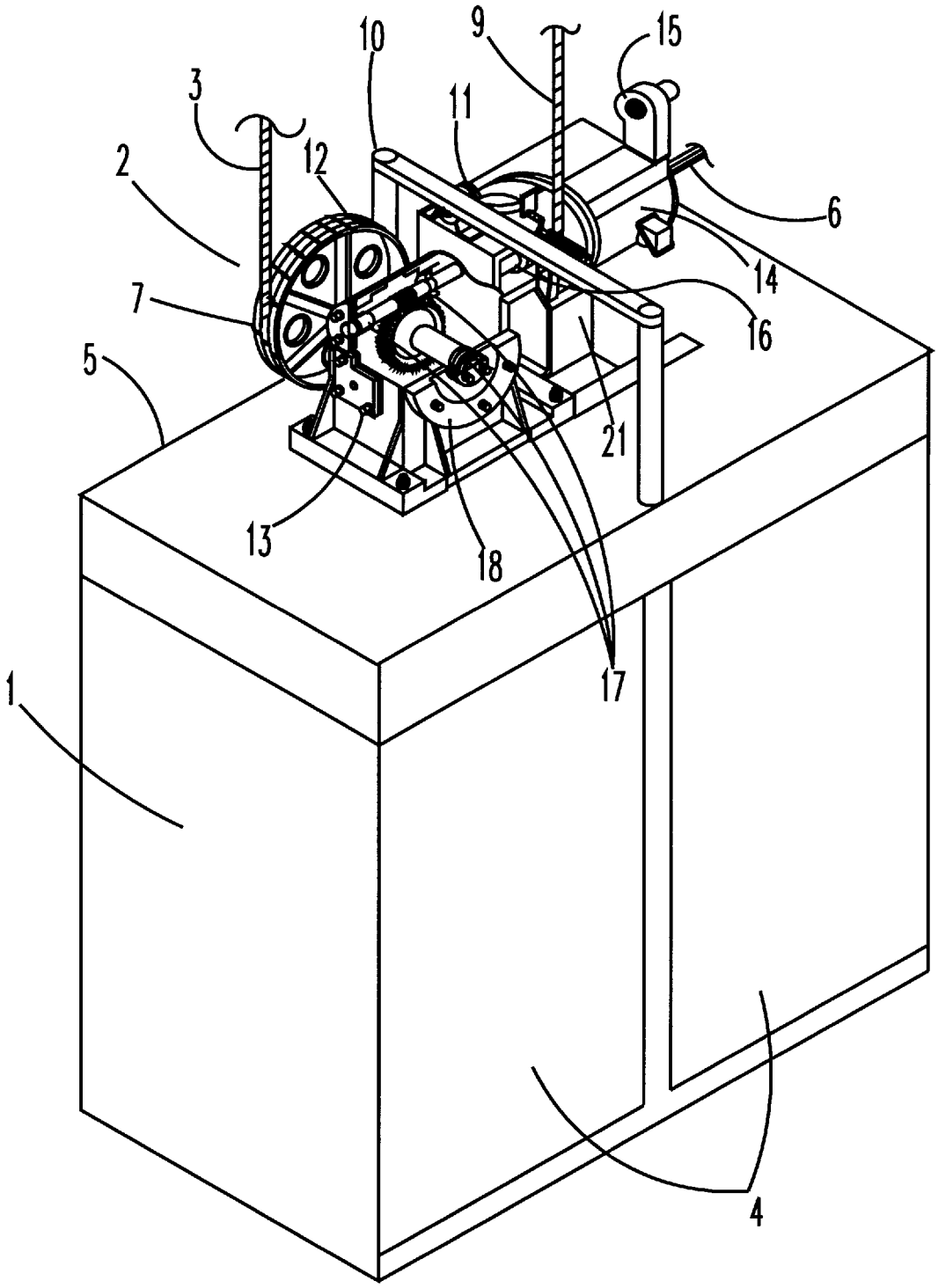
FIG. 4 is a perspective elevational view of a power drive unit installed in a cab according to the present invention.
Figure 5:
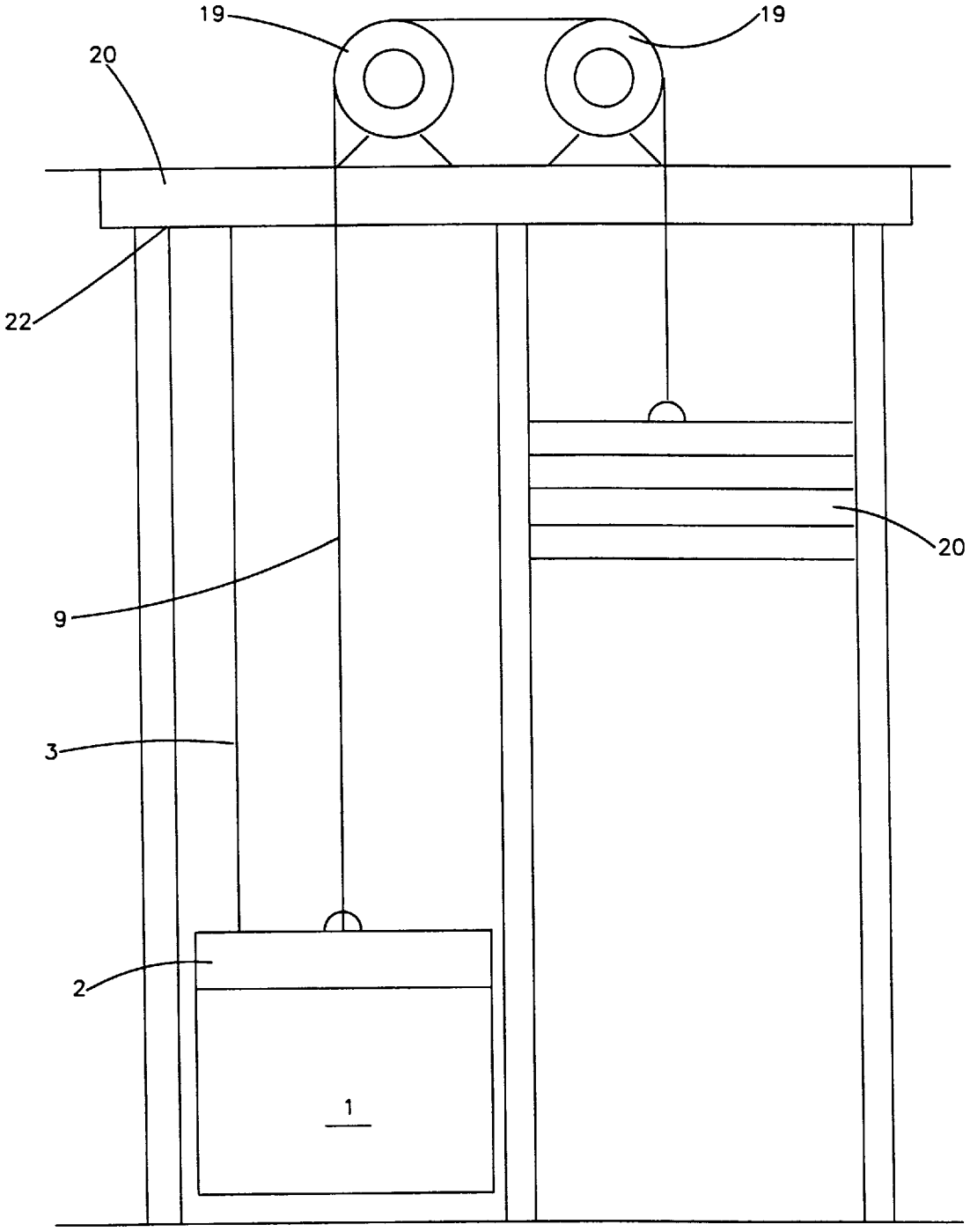
FIG. 5 is a schematic drawing showing the power drive unit installed in the cab at the top, and the host cable fixedly connected to a beam in the control room.

Referring to FIGS. 4 and 5, the top ends of the host cable 3 is fixedly connected to a cable mount 22 at a beam 30 at the top of the elevator well, the power drive unit 2 and the cab 1 are moved up and down by means of the operation of a winch 7 in taking up and letting off the host cable 3. A frame 10 is fixedly mounted on the cab 1 at the top to hold one end of a counterweight cable 9. The opposite end of the counterweight cable 9 is inserted through two pulleys 19 at the beam 30, and then connected to weights 20.

Referring to FIGS. 4 and 5 again, the power drive unit 2 is fixedly mounted on the top 5 of the cab 1, comprising a winch 7 controlled to take up or let off the host cable 3, a counterweight cable 9 inserted through two pulleys 19 and connected to weights 20, a reversible motor 14 controlled to turn the winch 7, an electromagnetic brake 11, a fan 15 for cooling, a brake block 16 controlled by the electromagnetic brake 11 to stop the reversible motor 14, a battery 21 adapted for providing DC power supply to the reversible motor 14 in case of AC power failure, and a reducing gear 18 supported on bearings 17 and coupled between the power output end of the reversible motor 14 and the power input end of the winch 7. The reducing gear 18 is comprised of a worm 12 and a worm gear 13 meshed together. Normally, AC power supply is provided to the reversible motor 14 for working. In case of AC power failure, the power supply of the battery 21 is automatically transmitted to the reversible motor 14 through an automatic switch means (not shown).

Figure 6:
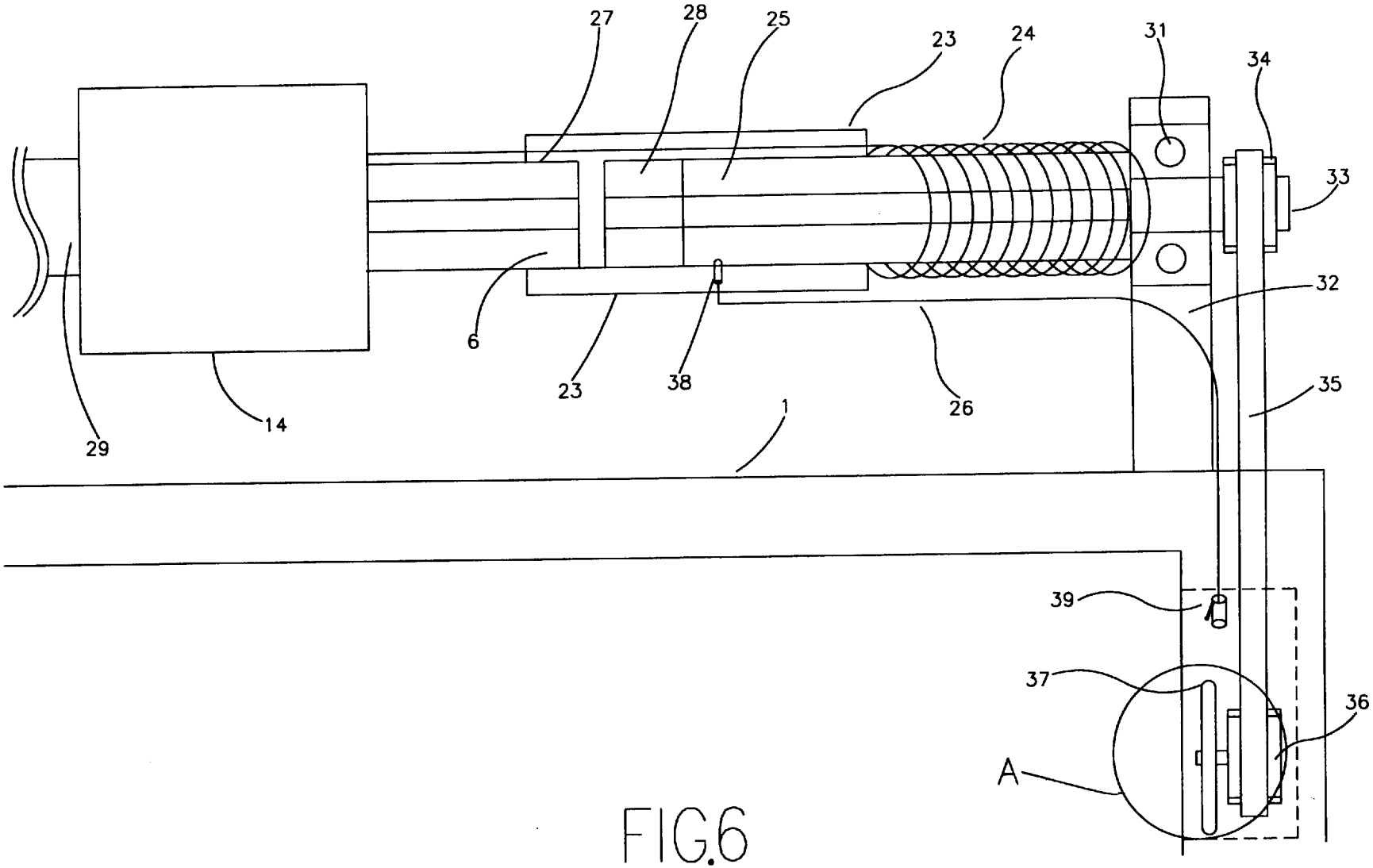
FIG. 6 shows the arrangement of the clutch barrel, the compression spring, the gear shaft, the chain transmission mechanism, the hand wheel, and the clutch switch according to the present invention.
Figure 6A:
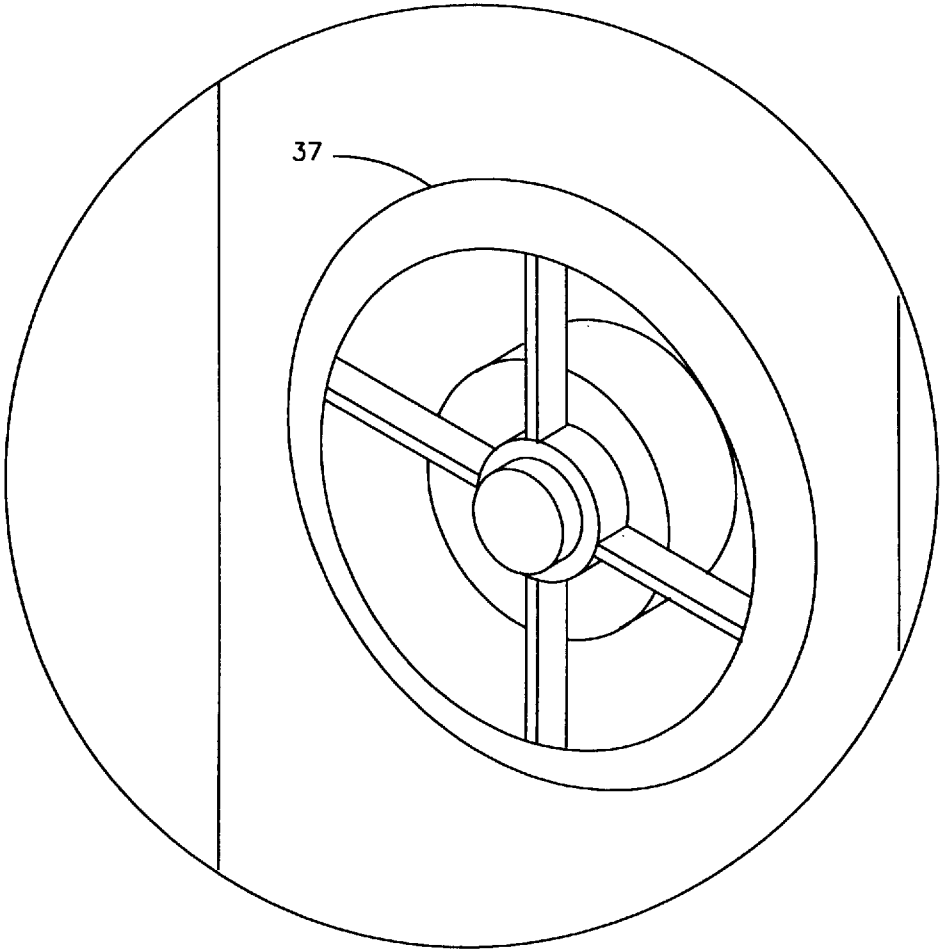
FIG. 6A is an enlarged view of the hand wheel shown in FIG. 6.
Figure 7:
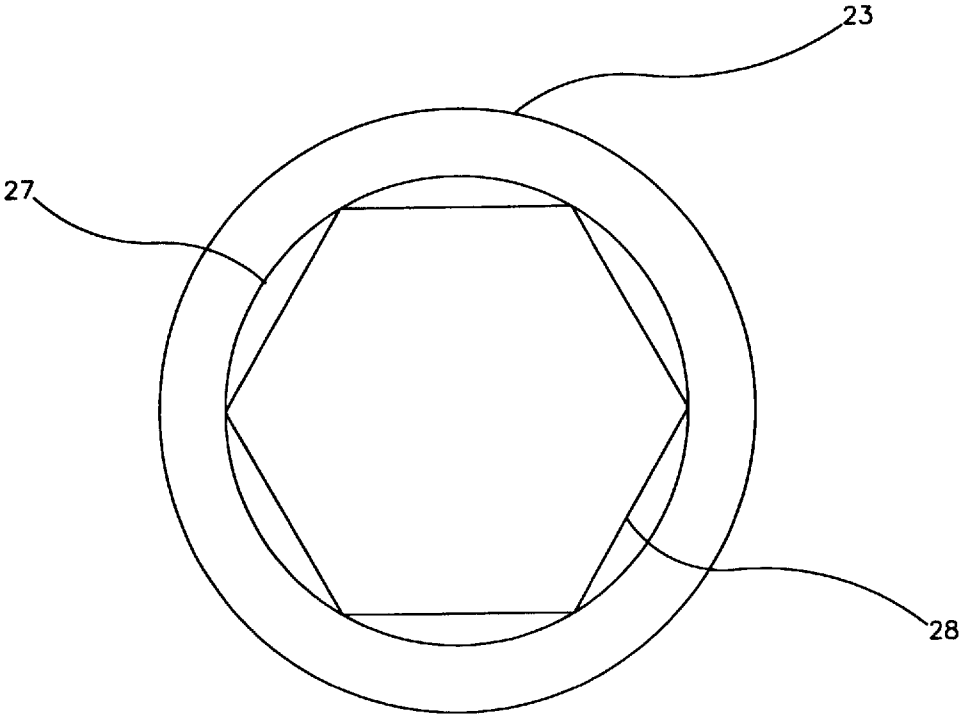
FIG. 7 is a front view of the clutch barrel according to the present invention.
Figure 8:
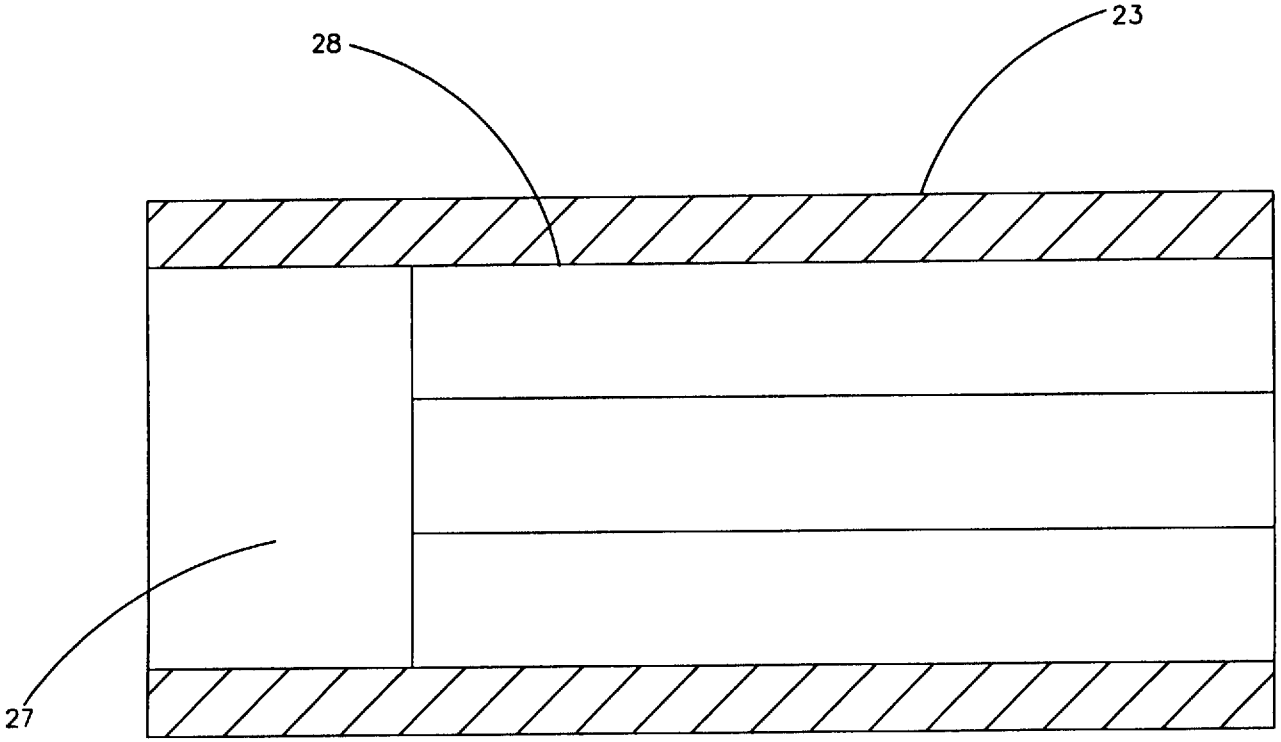
FIG. 8 is a sectional side view of the clutch barrel according to the present invention.

Referring to FIGS. 6, 7, and 8, the front motor shaft 29 of the reversible motor 14 is connected to the worm 12 of the aforesaid reducing gear 18. The reversible motor 14 further comprises a rear extension shaft 6 turned with the front motor shaft 29. The rear extension shaft 6 has a square or hexagonal cross section. A gear shaft 25 is coupled to the rear extension shaft 6 by a clutch barrel 23. As illustrated in FIG. 7 and 8, the clutch barrel 23 has a rounded coupling hole 27 at one end coupled to the rear extension shaft 6, and a polygonal coupling hole 28 at an opposite end coupled to the gear shaft 25. The gear shaft 25 has one end inserted into the polygonal coupling hole 28 of the clutch barrel 23. The opposite end of the gear shaft 25 is a round rod 33 mounted in a bearing 31 in a hole (not shown) in a support 32, which is fixedly mounted on the cab 1 at the top. A first sprocket wheel 34 is fixedly mounted around the round rod 33 of the gear shaft 25, and coupled to a second sprocket wheel 36 by a chain 35. A hand wheel 37 is coupled to the second sprocket wheel 36 for turning it. Therefore, the gear shaft 25 can be turned by the hand wheel 37 through the sprocket wheels 34 and 36, and the chain 35. A compression spring 24 is mounted around the gear shaft 25, and stopped between the clutch barrel 23 and the support 32. A locating pin 38 is fastened to the clutch barrel 23 and the gear shaft 25 to fix them together. The diameter of the rounded coupling hole 27 of the aforesaid gear shaft 25 is bigger than the outer diameter of the rear extension shaft 6 of the reversible motor 14. Therefore, when the reversible motor 14 is operated, the rear extension shaft 6 is turned in the rounded coupling hole 27 of the gear shaft 25 in idle, and the driving power of the reversible motor 14 is not transmitted to the gear shaft 25.

Figure 9:
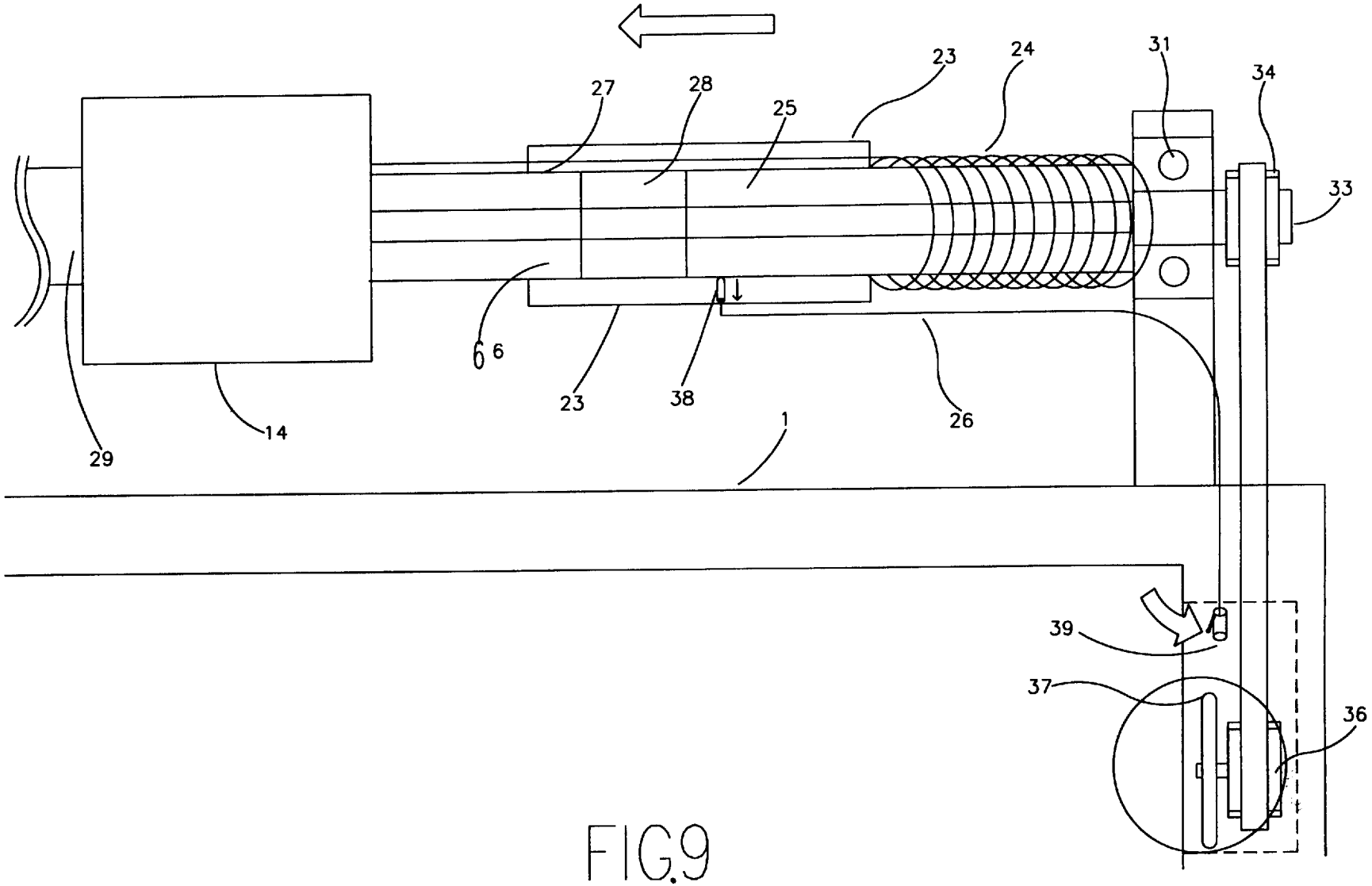
FIG. 9 is similar to FIG. 6 but showing the clutch barrel engaged with the rear extension shaft of the reversible motor; and, FIG. 10 is a schematic drawing of the present invention, showing a view hole in the cab, and fluorescent floor marks marked on the wall of the elevator well.

Referring to FIG. 9 and FIG. 6 again, the locating pin 38 is connected to a clutch switch 39 inside the cab 1 by a wire 26. When the clutch switch 39 is pulled, the locating pin 38 is disconnected from the gear shaft 25. When the locating pin 38 is disconnected from the gear shaft 35, the clutch barrel 23 is immediately forced forwards by the compression spring 24, thereby causing the polygonal coupling hole 28 of the clutch barrel 23 to be forced into engagement with the rear extension shaft 6, and therefore, the rear extension shaft 6 and the gear shaft 25 are linked together by the polygonal coupling hole 28 of the clutch barrel 23 and can be turned by the hand wheel 37. Because the hand wheel 37 and the clutch switch 39 are installed in the cab 1 on the inside, the passengers can pull the clutch switch 39 to disconnect the locating pin 38 from the gear shaft 25 for permitting the gear shaft 25 to be coupled to the rear extension shaft 6 of the reversible motor 14, and then turn the hand wheel 37 to drive the winch 7 in taking up or letting off the host cable 3 (see also FIG. 4), so as to lift or lower the cab 1 to the desired elevation. The clutch switch 39 and the hand wheel 37 may be covered with an access door so that their installation does not destroy the sense of beauty of the inside arrangement of the cab 1.

Figure 10:
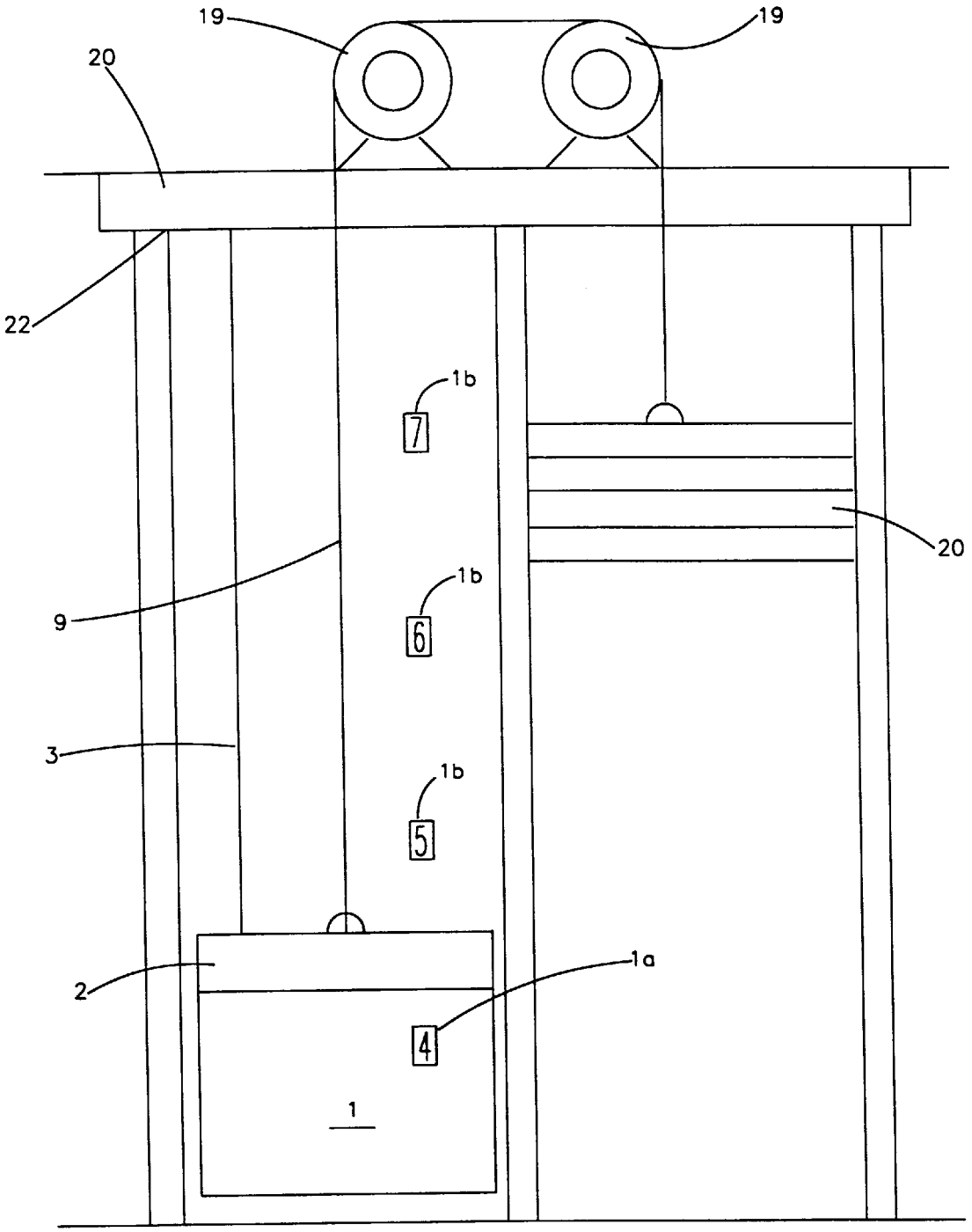

Referring to FIG. 10, the cab 1 has a view hole 1*a* through which the passengers can see fluorescent floor marks 1*b* in the wall of the elevator well, so as to quickly find out the position of the cab 1 in an emergency case.

Furthermore, a second hand wheel may be installed in the cab 1 on the inside so that the passengers can open the door 4 of the cab 1 manually in an emergency case.

While only one embodiment of the present invention has been shown and described, it will be understood that various modifications and changes could be made thereunto without departing from the spirit and scope of the invention disclosed. For example, a gear transmission mechanism may be installed to replace the sprocket wheels 33, 36 and the chain 35 for power transmission from the hand wheel 37 to the gear shaft 25. When the present invention is employed to a fire escape cage, safety belts and shock absorbing means shall be provided.

What the invention claimed is:

1. An elevator with electric/manual dual driving-mode comprising a cab moved in an elevator well, and a power drive mounted on said cab and operated to lift and lower said cab in said elevator well, said power drive comprising host cable means suspended from a beam at a top in said elevator well and connected to said winch, a reversible motor having a motor shaft, a winch coupled to one end of the motor shaft of said reversible motor by a reducing gear and turned by said reversible motor to take up/let off said host cable means in lifting/lowering said cab, and a manual drive means for turning said reversible motor in driving said winch manually by a person in said cab, wherein said manual drive means comprises:

a support fixedly mounted on said cab on the outside and holding an axle bearing;

a gear shaft supported on the axle bearing of said support;

clutch means controlled by a clutch switch to couple said gear shaft to the motor shaft of said reversible motor;

a transmission mechanism;

handle means disposed inside said cab and coupled to said gear shaft by said transmission mechanism, and turned to rotate said gear shaft through said transmission mechanism; and a clutch switch controlled to move said clutch means into engagement with said gear shaft and the output shaft of said reversible motor, for permitting the output shaft of said reversible motor to be turned with said gear shaft.

2. The elevator with electric/manual dual driving-mode of claim 1 wherein said transmission mechanism is comprised of a first sprocket wheel fixedly mounted around said gear shaft at one end remote from said clutch means, a second sprocket wheel mounted in said cab and coupled to said handle means, and a chain coupled between said first sprocket wheel and said second sprocket wheel.

3. The elevator with electric/manual dual driving-mode of claim 1 wherein said clutch means comprises a clutch barrel having a rounded coupling hole at one end sleeved onto a polygonal rear extension shaft at one end of the output shaft of said reversible motor and a polygonal coupling hole at an opposite end sleeved onto a polygonal gear shaft section of said gear shaft, a locating pin inserted into a hole in said clutch barrel and a hole in the polygonal shaft gear shaft section of said gear shaft to connect said clutch barrel and said gear shaft together, a compression spring mounted around said gear shaft and stopped between said clutch barrel and said support, and a wire connected between said locating pin and said clutch switch, said wire being driven by said clutch switch to pull said locating pin away from said gear shaft, thereby causing said clutch barrel to be forced forward by said compression spring to move the polygonal coupling hole of said clutch barrel into engagement with said polygonal rear extension shaft for power transmission from said transmission mechanism to said winch through said reversible motor via said gear shaft and said clutch barrel.

4. The elevator with electric/manual dual driving-mode of claim 1 wherein said handle means is a hand wheel.

5. The elevator with electric/manual dual driving-mode of claim 1 wherein said handle means is a crank handle.

6. The elevator with electric/manual dual driving-mode of claim 1 further comprises a hand wheel adapted for turning a door of said cab manually by a person inside said cab.

* * * * *